United States Patent [19]

Lundin

[11] Patent Number: 4,988,006

[45] Date of Patent: Jan. 29, 1991

[54] FLEXIBLE POCKET DIVIDER AND SUPPORT ASSEMBLY

[75] Inventor: David J. Lundin, Cedar Park

[73] Assignee: Minnesota Mining and Manufacturing Company, St. Paul, Minn.

[21] Appl. No.: 328,018

[22] Filed: Mar. 23, 1989

[51] Int. Cl.[5] ..... A47F 7/16

[52] U.S. Cl. ..... 211/46; 211/45

[58] Field of Search ..... 211/46, 45, 124, 162; 312/184, 183

[56] References Cited

U.S. PATENT DOCUMENTS

| | | | |
|---|---|---|---|
| 2,350,754 | 6/1944 | Guichard | 211/162 |
| 2,563,226 | 8/1951 | Ellis | 211/162 |
| 3,175,697 | 3/1965 | Kelly | 211/162 |
| 3,255,758 | 6/1966 | Gauche | 312/184 X |
| 4,527,693 | 7/1985 | Bolt et al. | 211/46 |
| 4,527,694 | 7/1985 | Bolt et al. | 211/46 |
| 4,703,982 | 11/1987 | Röck et al. | 312/183 X |

FOREIGN PATENT DOCUMENTS

| | | | |
|---|---|---|---|
| 142772 | 8/1951 | Australia | 312/184 |
| 157557 | 7/1954 | Australia | 211/124 |
| 544687 | of 1932 | Fed. Rep. of Germany | 312/184 |
| 1183871 | 7/1959 | France | 312/184 |
| 569278 | 5/1945 | United Kingdom | 312/184 |

OTHER PUBLICATIONS

3M Velostat; "4400A Series, Electrically Conductive Static-Shielding, Container System", Nepcor/West Conference, 1980.

*Primary Examiner*—David L. Talbott
*Assistant Examiner*—Daniel Hulseberg
*Attorney, Agent, or Firm*—Donald M. Sell; Walter N. Kirn; Jack V. Musgrove

[57] ABSTRACT

A device for partitioning a container into a plurality of flexible pockets. A single sheet is draped over several parallel rods which are supported by two side rails. Each rod is slidably attached to the side rails by means of a novel rod support. The rod support has a collar for receiving one end of a rod, a boss for engaging one side of the rail, and a beam terminating in a flange for engaging the other side and bottom of the rail. A hinged clip may be added to the rod support for securing the sheet to the rods.

17 Claims, 3 Drawing Sheets

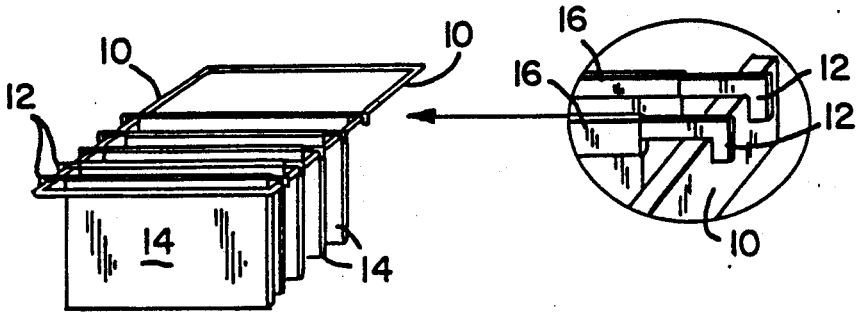
Fig. 1 (PRIOR ART)
Fig. 2 (PRIOR ART)
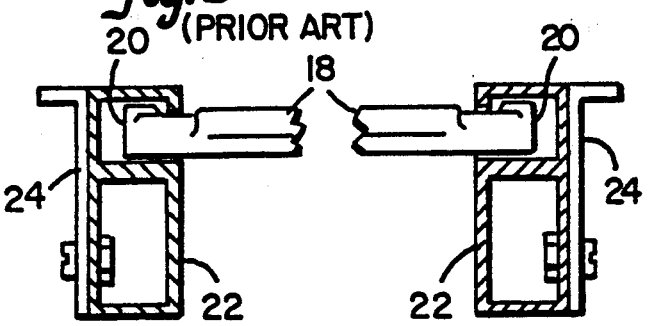
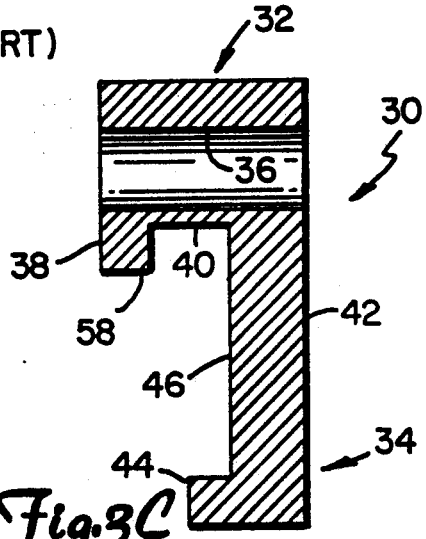
Fig. 3C
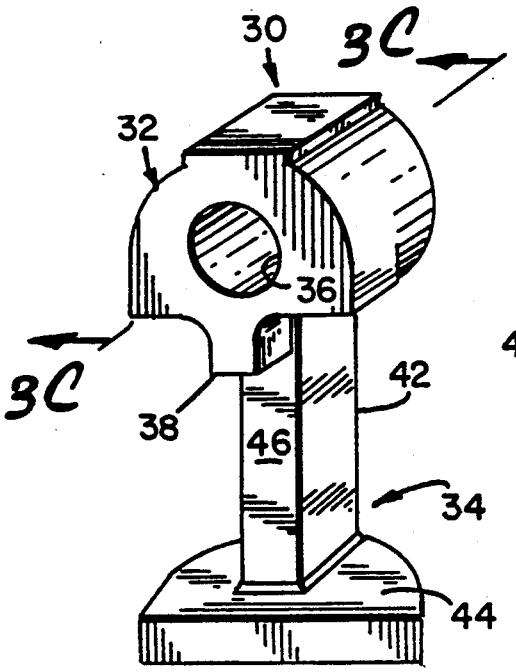
Fig. 3A
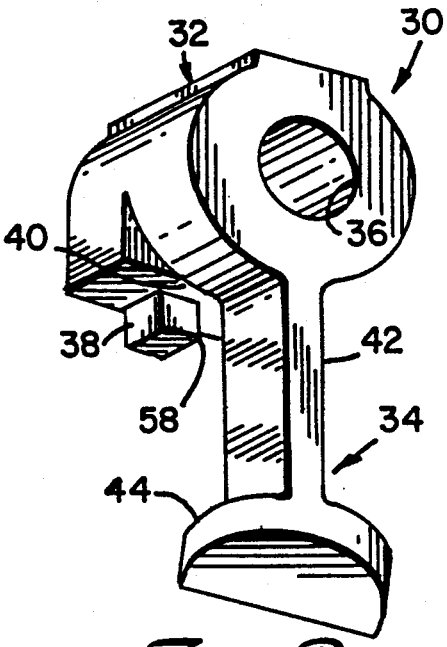
Fig. 3B

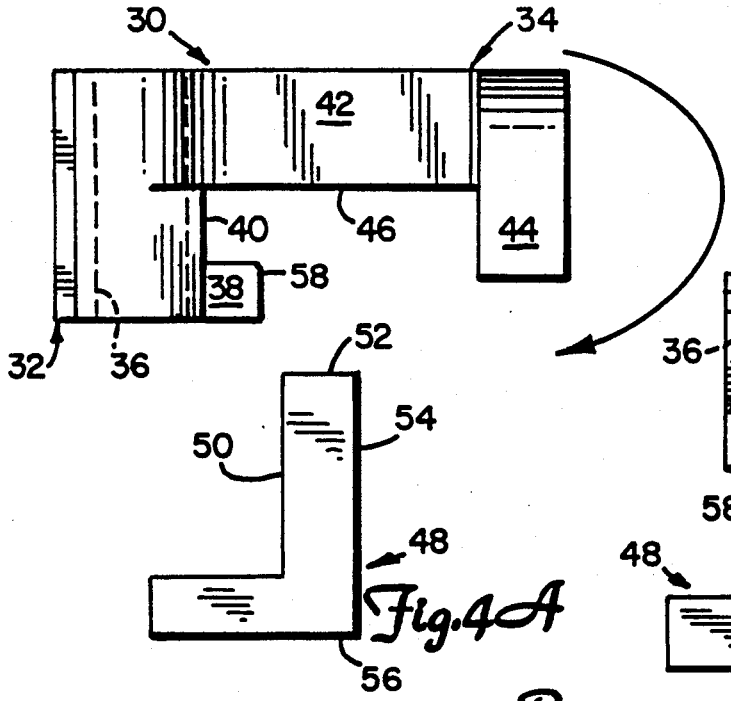
Fig. 4A
Fig. 4B
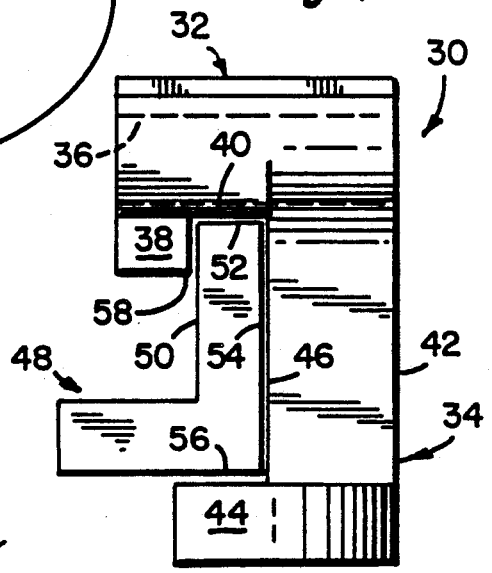
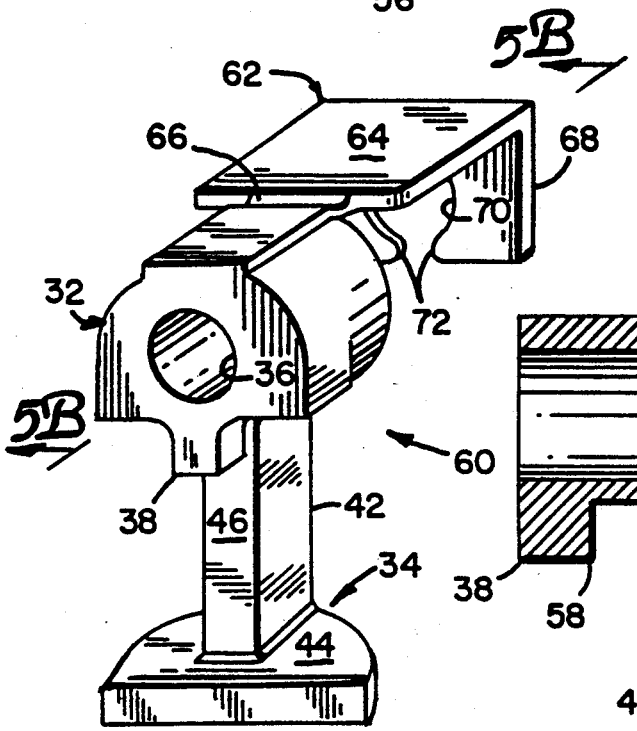
Fig. 5A
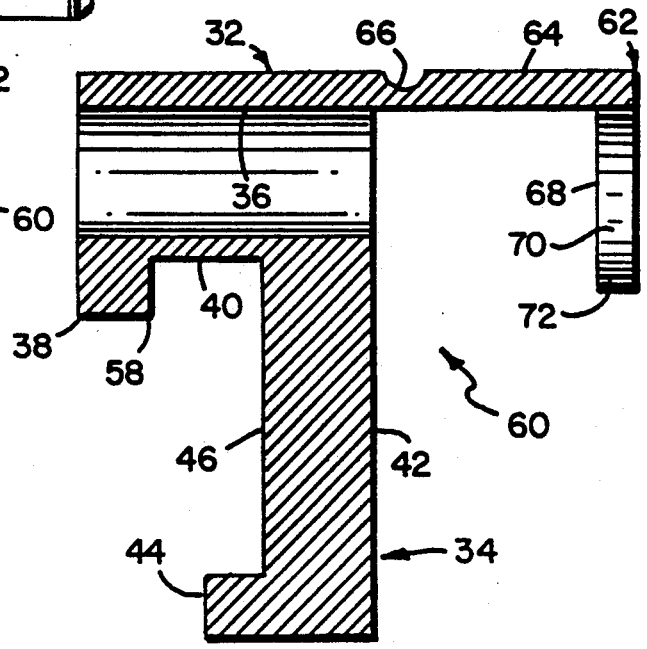
Fig. 5B

Fig. 6B
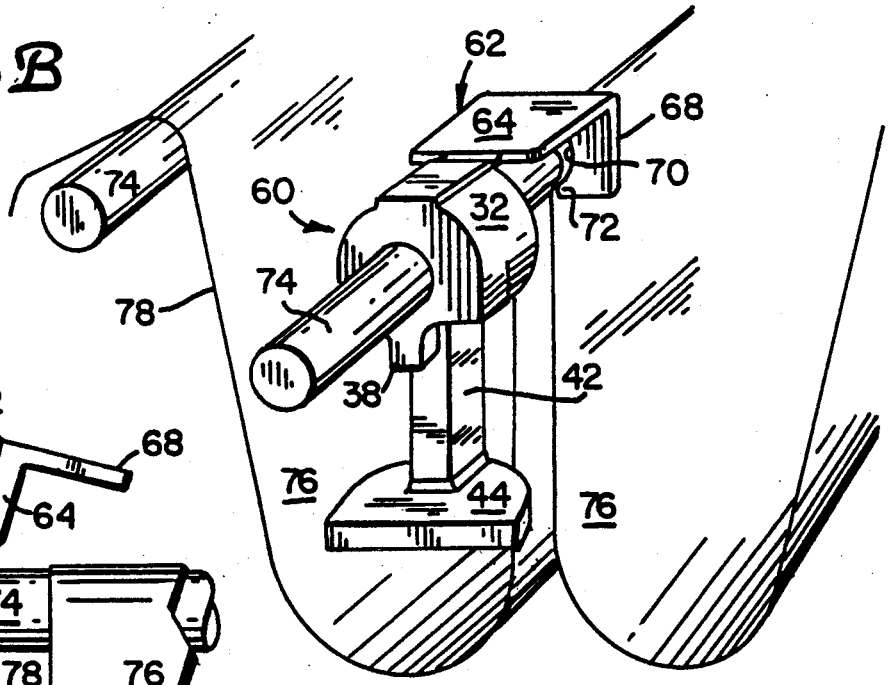
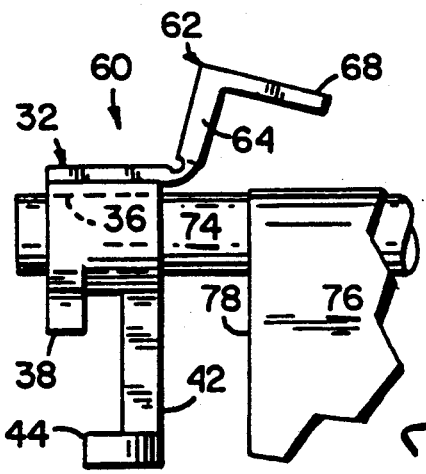
Fig. 6A
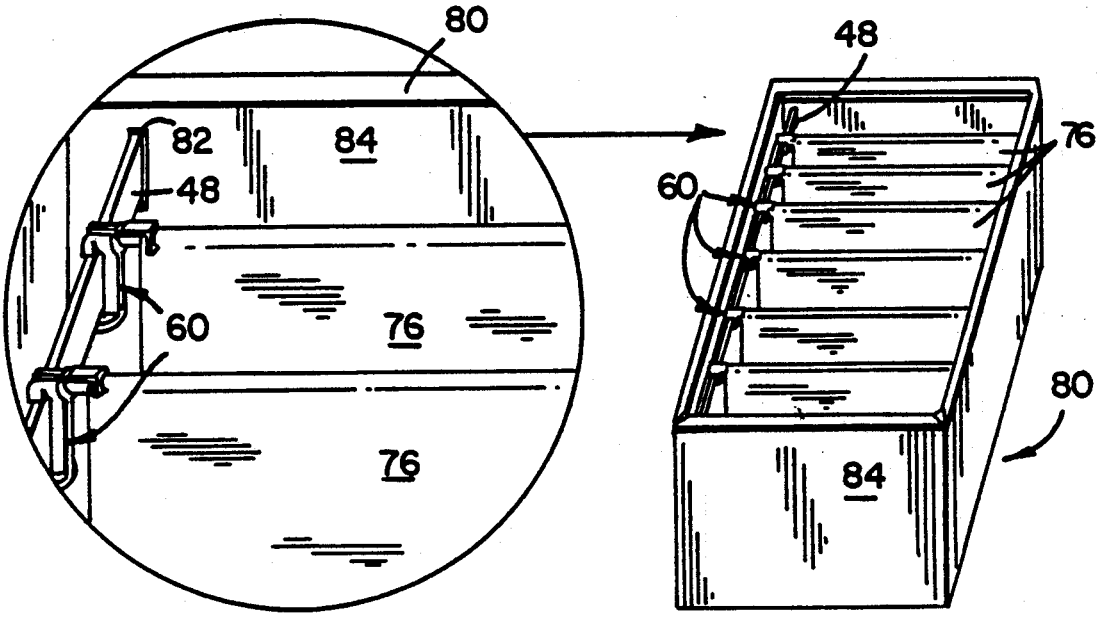
Fig. 7

FLEXIBLE POCKET DIVIDER AND SUPPORT ASSEMBLY

Background of the Invention

1. Field of the Invention

The present invention generally relates to containers and folders, and more particularly to a flexible pocket divider which may be used for filing papers or separating generally planar objects, such as printed circuit boards, and a support assembly therefor.

2. Description of the Prior Art

It is often convenient to utilize a partitioned container for receiving various objects, such as papers or other generally planar articles. For example, one popular hanging folder system is sold by Esselte Corporation of Garden City, N.Y., under the trademark PENDAFLEX. This type of hanging folder is depicted in FIG. 1, which includes a closeup of the support system for the folders. Generally, two parallel rails 10, which are typically mounted at their ends within a drawer or file cabinet, support a plurality of hooks 12 to which the folders 14 are attached. Hooks 12 are formed integrally with bars 16 which run the length of folders 14. Folders 14 are basically folded in half, each of the subsequent ends being looped to receive bars 16. Thus, a given folder 14 requires two bars 16 and a total of four hooks 12. while several folders are usually placed within a file drawer, each folder is physically separate from the others.

Another prior art folder system is illustrated in FIG. 2. That figure shows the support assembly for the suspendable folders disclosed in U.S. Pat. No. 4,527,694 issued to Bolt et al. A rod 16 having flanged ends 20 is supported by channel brackets 22 Which are in turn mounted to the walls 24 of a drawer or cabinet. Folders (not shown) may then be attached to rods 18 in a fashion similar to the PENDAFLEX folders. The '694 patent does, however, teach an alternative method of attachment of the folders. A given folder has only one looped end which is threaded over rod 18. The other end, which would otherwise dangle below the support structure, is adhered to the backside of an adjacent folder. In this manner, the double-walled folder arrangement seen with the PENDAFLEX folders is obviated.

The above folder systems have several drawbacks. Each folder is only a specified size; both the width of the folder and the hanging length are predetermined, making it difficult to accommodate objects of unusual dimensions. Secondly, the folder material used in the prior art is permanently attached to the supporting structure, so it is impossible to substitute a different material to a preexisting framework. Finally, with respect to the '694 patent, it is difficult to retrofit the supporting brackets to a file cabinet already in place. It would, therefore, be desirable and advantageous to devise a folder system which overcomes these limitations.

Accordingly, the primary object of the present invention is to provide a flexible pocket-type divider system.

Another object of the invention is to provide such a system wherein the width and length of the folder pockets are easily adjusted.

Still another object of the invention is to provide a folder or divider which may easily be adapted to existing file cabinets and the like.

Yet another object of the invention is to provide a flexible pocket divider which may receive a variety of different folder materials.

SUMMARY OF THE INVENTION

The foregoing objects are achieved in a flexible pocket divider having rod members, a continuous sheet of folder material, and means for supporting the ends of the rod members. The support means has a hole therein for receiving the rod member, a boss for catching the top edge of a support rail, and a flange member which abuts the bottom edge of the support rail. In the preferred embodiment, special hinged clips are used to clasp the continuous sheet folder material to the rod members.

BRIEF DESCRIPTION OF THE DRAWINGS

The novel features of the invention are set forth in the appended claims. The invention itself, however, will best be understood by reference to the accompanying drawings, wherein:

FIG. 1 is a perspective view of the prior art PENDAFLEX folders, with a close-up detail of the support structure.

FIG. 2 is a side view of the support structure of the hanging framework from U.S. Pat. No. 4,527,694.

FIG. 3A is a front perspective view; FIG. 3B a rear perspective view; and FIG. 3C a cross-sectional view (along line 3C—3C of FIG. 3A) of the novel rod support of the present invention.

FIGS. 4A and 4B are side elevational views depicting the method of attachment of the rod supports to a support rail.

FIG. 5A is a front perspective view, and FIG. 5B is a cross-sectional view (along line 5B—5B of FIG. 5A) showing a unique clip feature added to the rod support of the present invention.

FIG. 6A is a side elevational view of the rod support of the present invention showing the hinged clip; FIG. 6B is a perspective view showing the hinged clip clamped about the sheet material and suspension rod.

FIG. 7 is a perspective view of a tote box employing the present invention, with a detail showing the support assembly of the present invention.

DESCRIPTION OF THE PREFERRED EMBODIMENT

With reference now to the figures, and in particular with reference to FIGS. 3A, 3B and 3C, there is depicted a novel rod support 30 of the present invention. Rod support 30 may be constructed of any durable material, including metal or plastic. The preferred material is polypropylene, suitable for injection molding. Rod support 30 includes top portion 32 and bottom portion 34. Top portion 32 has a hole 36 therein for passage of a suspension rod (shown in FIGS. 6A and 6B) which supports the folder material. Top portion 32 is, therefore, essentially a collar.

As those skilled in the art will appreciate, hole 36 need not be circular, although a cylindrical rod is employed in the preferred embodiment. For example, flat rails or bars could be used, in which case hole 36 would appear as a slot. Therefore, the term "rod," as used throughout the specification and claims, is not to be construed in a limiting sense, but rather implies any elongated member. Also, hole 36 need not completely penetrate top portion 32. A recessed cavity would be sufficient to hold the suspension rod in place, but a complete bore is preferred to facilitate assembly of the entire pocket divider, which allows non-critical dimensioning of the rods. It is also preferable to have a fairly tight fit between the suspension rod and hole 36 to provide a frictional impediment to longitudinal movement of the rods.

Top portion 32 of rod support 30 also includes a protuberance or boss 38 which extends from and is generally perpendicular to a flat surface 40. Bottom portion 34 of rod support 30 consists of an extension or beam 42 and flange 44, beam 42 having an inner surface 46. Boss 38 and flange 44 are utilized to attach rod support 30 to a support rail, as illustrated in FIGS. 4A and 4B.

Referring now to FIGS. 4A and 4B, the support rail 48 is shown. Although support rail 48 could be an essentially flat rail with a rectangular cross-section, an L-shaped section is preferred as this provides transverse strength and prevents bowing of the rail. Support rail 48 defines an outer surface 50, upper surface 52, inner surface 54, and bottom surface 56. Support rail 48 is usually metallic (aluminum) and is attached to the file drawer or other container by any convenient means (see the discussion of FIG. 7).

In coupling rod support 30 to support rail 48, rod support 30 is first held above rail 48, with boss 38 proximate surface 50 as depicted in FIG. 4A. As rod support 30 is lowered over support rail 48, rod support 30 is rotated, while positioning top surface 52 of rail 48 adjacent flat surface 40 of rod support 30. In the coupled state (FIG. 4B), boss 38 abuts outer surface 50 of rail 48, surfaces 52 and 54 of rail 48 are flush against surfaces 40 and 46, respectively, and flange 44 abuts bottom surface 56 of rail 48. Boss 38 and beam 42 together prevent lateral movement of rod support 30. In this manner, rod support 30 is securely attached to support rail 48.

In order to facilitate assembly, the inner edge 58 of boss 38 is somewhat rounded. By providing a sufficient tolerance between the mating surfaces, rod support 30 easily slides (longitudinally) along rail 48, but lateral, vertical and rotational movement relative to rail 48 is restricted. As those skilled in the art will appreciate, the above-described orientation of rod support 30 is somewhat relative; it could be attached in an upside-down manner to rail 48. Also, if a flat rail (rather than L-shaped) is used, then rod support 30 may be mounted on either side of the rail, i.e., boss 38 may be on the same side of the rail from which the suspension rod extends.

Once rod support 30 has been attached to support rail 48, a suspension rod or other longitudinal member may be inserted into hole 36. Alternatively, a rod may first be inserted into hole 36, and then rod support 30 attached to support rail 48. TWo rod supports 30 are used for a given rod, one at each end. The suspension rods carry pocket folders having looped ends, similar to the folders utilized in the prior art. The present invention has a distinct advantage over the Bolt et al. device, however, in that the rod supports 30 are easily disengaged from support rail yet rod supports 30 keep the suspension rods more securely coupled to support rail 48 than do the hooks 12 of a PENDAFLEX file.

With further reference to FIGS. 5A and 5B, an improved rod support 60 is shown. Improved rod support 60 is essentially identical to rod support 30 with the addition of a clip 62. Although clip 62 could be a separate article (in which case it could take on several different forms), it is preferably formed integrally with improved rod support 60. Clip 62 includes a cantilever 64 attached to top portion 32 by means of a living hinge 66, and a clip plate 68. Clip plate 68 has a cutout 70 therein defining two lobes 72.

Use of the improved rod support 60 is illustrated in FIGS. 6A and 6B. In those figures, a suspension rod 74 (preferably aluminum) has been inserted into hole 36. This may occur before or after improved rod support 60 has been coupled to the support rail (which is not shown in FIGS. 6A and 6B for clarity). With clip 62 raised above rod 74, a sheet 76 of folder material is draped from rod 74 with its side edge 78 positioned under clip 62 (FIG. 6A). Then clip 62 is lowered, and lobes 72 snap into place, securing sheet 76 to rod 74 as shown in FIG. 6B. Clip 62 not only secures sheet 76 to rod 74, but also provides a frictional impediment to longitudinal movement of rod 74.

As noted above with respect to rod support 30, improved rod support 60 may be mounted on either side of a flat (as opposed to L-shaped) rail; however, if rod support 60 were oriented in a manner opposite that shown in FIGS. 6A and 6B, then clip 62 would necessarily be attached to the opposite side of top portion 32, i.e., the side of boss 38. This construction is, however, deemed much less desirable than the depicted embodiment.

The use of clip 62 with improved rod support 60 provides three clear advantages. First, a single, continuous sheet of the folder material may be suspended from the rods to create single or multiple folder pockets, which simplifies both manufacture and assembly. Secondly, different sheets (having different widths, colors, material properties, etc.) may easily be interchanged by means of improved rod supports 60. Finally, the hanging length of the folder pockets is adjusted simply by loosening clip 62, pulling the extra length of sheet material 76 over rod 74, and re-fastening clip 62.

Due to the fact that rod supports 60 require only a simple rail for structural support, the present invention is also easily adapted to existing file cabinets, drawers, etc. For example, one use of the present invention is in tote boxes for carrying static-sensitive articles, such as printed circuit (PC) boards with semiconductor components (discussed in the Bolt et al. patent, which is hereby incorporated by reference). FIG. 7 depicts use of the present invention in such a box.

Box 80, which is typically constructed of a static-dissipative material, is modified by making cutouts 82 in the end walls 84 which accommodate rails 48. Alternatively, some standard tote boxes have a plurality of vertical slots along the sidewalls for receiving the PC boards and, for such boxes, rigid inserts may be placed at the inner ends of the box, the inserts having cutouts 82 therein. For the flexible pockets, sheet 76 would be an insulative, conductive or static-dissipative sheet, depending on the particular protection required. For example, Minnesota Mining & Manufacturing Co. of St. Paul, Minn., markets a conductive sheet under the trademark VELOSTAT which may be used in this application. It is anticipated, however, that a two-layer anti-static sheet would be used in the preferred embodiment of the anti-stat tote box. The two-layer sheet (known in the prior art) consists of a first layer which is static-dissipative, allowing static charge to drain to the second layer, which is conductive. The conductive layer would be in contact with rods 74, while the static-dissipative layer would be in contact with clip plate 68, i.e., PC boards laid between folder pockets would be in contact with the static-dissipative layer. Rod supports 60 should also be at least partially conductive to allow static charge to drain away from sheet 76 and rods 74.

Although the invention has been described with reference to specific embodiments, this description is not meant to be construed in a limiting sense. Various modifications of the disclosed embodiment, as well as alternative embodiments of the invention, will become apparent to persons skilled in the art upon reference to the description of the invention. For example, the rod support 30 may be used to support any longitudinal member, and is not limited to use in flexible pocket dividers. It is therefore contemplated that the appended claims will cover such modifications that fall within the true scope of the invention.

I claim:

1. An article for attaching the end of an elongated member to a rail having top and bottom surfaces, comprising:

means for receiving the elongated member, said receiving means having a flat exterior surface for contact with the top surface of the rail; and means for opposing rotational movement of said receiving means about the rail, wherein said means for opposing rotational movement comprises:

a boss member attached to said receiving means for contact with the rail, said boss member being generally perpendicular to said flat surface;

a beam member having first and second ends, said first end being attached to said receiving means with the beam member being generally perpendicular to said flat surface; and a flange means for abutting the bottom surface of the rail, said flange means being attached to said second end of said beam member.

2. The article of claim 1 wherein said receiving means comprises a collar member having a hole therein, said hole having a cross-section whose size and shape is equivalent that of the elongated member.

3. The article of claim 2 wherein said hole in said collar member extends completely through said collar member.

4. The article of claim 3 wherein the elongated member is a rod supporting a sheet of folder material, further comprising clip means for securing the sheet to the rod at any location along the sheet.

5. The article of claim 4 wherein said clip means is attached to said collar member.

6. The article of claim 5 wherein said clip means comprises:

a cantilever member generally parallel to said hole in said collar member, having first and second ends, said first end being pivotally attached to said collar member; and a clip plate attached to said second end of said cantilever member, said clip plate having a cutout therein for receiving the sheet and rod.

7. The article of claim 6 wherein said receiving means and said clip means are at least partially electrically conductive.

8. A device for containing generally planar objects, comprising:

at least one rail member having top, bottom, inner and outer surfaces;

at least one flexible sheet;

a plurality of rod members, said flexible sheet being suspended between at least two of said rod members, forming a pocket; and a plurality of rod supports, each said rod support comprising:

means for receiving one of said rod members, said receiving means having a flat exterior surface for contact with said top surface of said rail member, means for opposing rotational movement of said receiving means about said rail member, wherein said means for opposing rotational movement comprises:

a boss member attached to said receiving means for abutting said outer surface of said rail member, said boss member being generally perpendicular to said flat surface, a beam for abutting said inner surface of said rail member, said beam having first and second ends, said first end being attached to said receiving means with said beam being generally perpendicular to said flat surface, and a flange means for abutting the bottom surface of said rail member, said flange means being attached to said second end of said beam.

9. The device of claim 8 further comprising clip means for securing said sheet to one of said rod members at any location along said sheet.

10. The device of claim 9 wherein said receiving means comprises a collar having a hole extending therethrough, said hole being sized to accommodate one of said rod members.

11. The device of claim 10 wherein said clip means is attached to and integral with said collar.

12. The device of claim 11 wherein said clip means comprises:

a cantilever generally parallel to said hole in said collar member, having first and second ends, said first end being pivotally attached to said collar; and a clip plate attached to said second end of said cantilever, said clip plate having a cutout therein, said cutout surrounding one of said rod members and a portion of said sheet which is draped over said one of said rod members.

13. The device of claim 12 having only one flexible sheet, said flexible sheet being successively draped over said plurality of rod members, thereby forming a plurality of pockets.

14. The device of claim 13 having two of said rail members, each of said rail members being L-shaped, and further comprising:

container means; and means for affixing said rail members to said container means, said rail members being essentially parallel.

15. The device of claim 8 wherein said sheet is static-dissipative and said rod supports are at least partially electrically conductive.

16. A flexible pocket divider for partitioning a container into a plurality of flexible pockets, comprising:

first and second rails each having top, bottom, inner and outer surfaces;

means for affixing said first and second rails to the container, said first and second rails being generally parallel;

a plurality of generally parallel rods having first and second ends;

a flexible sheet successively draped over each of said rods, forming a plurality of pockets; and a plurality of rod supports slidably attaching said rods to said rails, there being one of said rod supports at each of said ends of each of said rods, each said rod support comprising:

a collar having a hole extending therethrough, said hole being sized to accommodate one of said rods, said collar having a flat exterior surface in contact with said top surface of said rails, a boss attached to said collar, said boss being generally perpendicular to said flat surface and abutting said outer surface of said rails, a beam abutting said inner surface of said rails, said beam having first and second ends, said first end being attached to said collar, said beam being generally perpendicular to said flat surface, a flange abutting said bottom surface of said rail, said flange being attached to said second end of said beam, a cantilever having first and second ends, said first end being integral with and pivotally attached to said collar, and a clip plate attached to said second end of said cantilever, said clip plate having a cutout therein, said cutout surrounding one of said rod members and a portion of said sheet which is draped over said one of said rod members.

17. The flexible pocket divider of claim 16 wherein:

said flexible sheet is static-dissipative;

said rods are at least partially electrically conductive;

said rod supports are at least partially electrically conductive; and said rails are at least partially electrically conductive.

* * * * *